US010446341B2

(12) United States Patent
Liu et al.

(10) Patent No.: US 10,446,341 B2
(45) Date of Patent: Oct. 15, 2019

(54) KEYPAD

(71) Applicant: Cooler Master (Shanghai) Technology Co., Ltd., Shanghai (CN)

(72) Inventors: Yong-Gang Liu, Huizhou (CN); Tian Gao, Shanghai (CN)

(73) Assignee: COOLER MASTER (SHANGHAI) TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/114,576

(22) Filed: Aug. 28, 2018

(65) Prior Publication Data

US 2019/0103237 A1 Apr. 4, 2019

(30) Foreign Application Priority Data

Oct. 2, 2017 (TW) ..... 106214667 U

(51) Int. Cl.

| | |
|---|---|
| ***H01H 13/06*** | (2006.01) |
| ***H01H 13/705*** | (2006.01) |
| ***H01H 13/14*** | (2006.01) |
| ***H01H 13/28*** | (2006.01) |
| ***H01H 13/85*** | (2006.01) |
| *H01H 13/86* | (2006.01) |
| *H01H 5/04* | (2006.01) |

(52) U.S. Cl.

CPC ..... *H01H 13/06* (2013.01); *H01H 13/14* (2013.01); *H01H 13/28* (2013.01); *H01H 13/705* (2013.01); *H01H 13/85* (2013.01); *H01H 5/045* (2013.01); *H01H 13/86* (2013.01); *H01H 2215/03* (2013.01); *H01H 2221/044* (2013.01); *H01H 2223/002* (2013.01); *H01H 2235/03* (2013.01)

(58) Field of Classification Search

CPC ..... H01H 2221/01; H01H 25/041; H01H 25/008; H01H 13/80; H01H 25/06; H01H 13/58; H01H 13/585; H01H 2223/00; H01H 2300/012; H01H 13/06; H01H 13/85; H01H 13/28; H01H 13/705; H01H 13/14; H01H 5/045; H01H 2235/03; H01H 2215/03; H01H 13/86; H01H 2223/002; H01H 2221/044

See application file for complete search history.

(56) References Cited

U.S. PATENT DOCUMENTS

2015/0213975 A1* 7/2015 Zheng ..... H01H 13/83 200/5 A

* cited by examiner

*Primary Examiner* — Ahmed M Saeed
(74) *Attorney, Agent, or Firm* — Kenja IP Law PC

(57) ABSTRACT

A keypad includes a base, an actuator, a first and second elastic member and a pivotal mechanism. The base has a through hole. The actuator is located in through hole to be moved between initial position and pressed position. The first elastic member is connected between the base and the actuator. The pivotal mechanism is pivotably and linearly movably disposed on the actuator to be moved between withdrawn position and protruding position. The second elastic member is connected between the actuator and the pivotal mechanism. The base has stop block and recess and the pivotal mechanism has tooth. While the actuator is moved to the pressed position, the tooth is stopped by the stop block so that the pivotal mechanism is pivoted and then linearly moved to the withdrawn position, and then enters into the recess, enabling the pivotal mechanism to the protruding position and press a switch.

9 Claims, 6 Drawing Sheets

KEYPAD

CROSS-REFERENCE TO RELATED APPLICATIONS

This non-provisional application claims priority under 35 U.S.C. § 119(a) on Patent Application No. 106214667 filed in Taiwan, R.O.C. on Oct. 2, 2017, the entire content of which is hereby incorporated by reference.

TECHNICAL FIELD

The disclosure relates to an input device, more particularly to a keypad.

BACKGROUND

A computer keyboard is the main input device for computers, and it uses an arrangement of keypads that can serve a variety of different functions. There are mechanical keyboard and membrane keyboard in the market. The mechanical keyboard has tactile switches that have a noticeable actuation point so that user can hear a "click" when the keypad is pressed. However, the sealing strength of the mechanical keyboard is lower than the membrane keyboard, so the mechanical keyboard has higher chance to let dust or wet air to go inside, result in failure. On the other hand, the mechanical keyboard is much compact in structure so that it can provide good sealing strength, such that it is capable of providing dust-proof and moisture-proof effects. Accordingly, developers are constantly trying to develop a new keypad that has advantages of both the mechanical keyboard and the membrane keyboard.

SUMMARY

The present disclosure provides a keypad capable which is capable of providing dust-proof and moisture-proof effects and a tactile feedback and a respective sound as well.

One embodiment of the disclosure provides a keypad including a base, an actuator, a first elastic member, a pivotal mechanism and a second elastic member. The base has a through hole. The actuator is movably located in through hole so as to be moved between an initial position and a pressed position with respect to the base. The first elastic member is located between and connected to the base and the actuator in order to provide force on the actuator to move the actuator towards the initial position. The pivotal mechanism is pivotably and linearly movably disposed on the actuator so as to be moved between a withdrawn position and a protruding position. The second elastic member is located between and connected to the actuator and the pivotal mechanism in order to provide force on the pivotal mechanism to move the pivotal mechanism towards the protruding position. The base has at least one stop block and at least one recess connected to each other on an inner surface forming the through hole, the pivotal mechanism has at least one tooth; when the actuator is in the initial position, the pivotal mechanism is in the protruding position; while the actuator is moved to the pressed position from the initial position, the at least one tooth of the pivotal mechanism is stopped by the at least one stop block so that the pivotal mechanism is pivoted and then linearly moved to the withdrawn position, and then enters into the at least one recess, enabling the pivotal mechanism to the protruding position and press a switch.

One embodiment of the disclosure provides a keypad including a base, a actuator inserted into the base, a pivotal mechanism, a first elastic member disposed between the base and actuator for recovering the actuator, a second elastic member disposed between the pivotal mechanism and the actuator for recovering the pivotal mechanism, the top side of the pivotal mechanism is inserted into the actuator, the base has a through hole and at least one stop block which is on an inner surface forming the through hole, the actuator is movably located in the through hole, and the bottom side of the pivotal mechanism has at least one tooth. When the actuator is pressed, the actuator forces the pivotal mechanism to pivot about a press direction of the actuator, such that the at least one stop block is moved away from the at least one tooth and moved toward the top side of the pivotal mechanism.

According to the keypad as discussed above, due to the cooperation of the protrusion and the slide groove, when the actuator is being pressed, the protrusion of the pivotal plunger is guided by the guide groove of the actuator and the second elastic member to make the teeth on the pivotal plunger to hit the bottom surface of the base so as to produce a sound. Therefore, in the case that the keypad of the present disclosure to be used in a membrane keyboard, it not only can provide dust-proof and moisture-proof effects but also can provide a tactile feedback and a respective sound similar to that of a mechanical keypad.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

Figure 1:
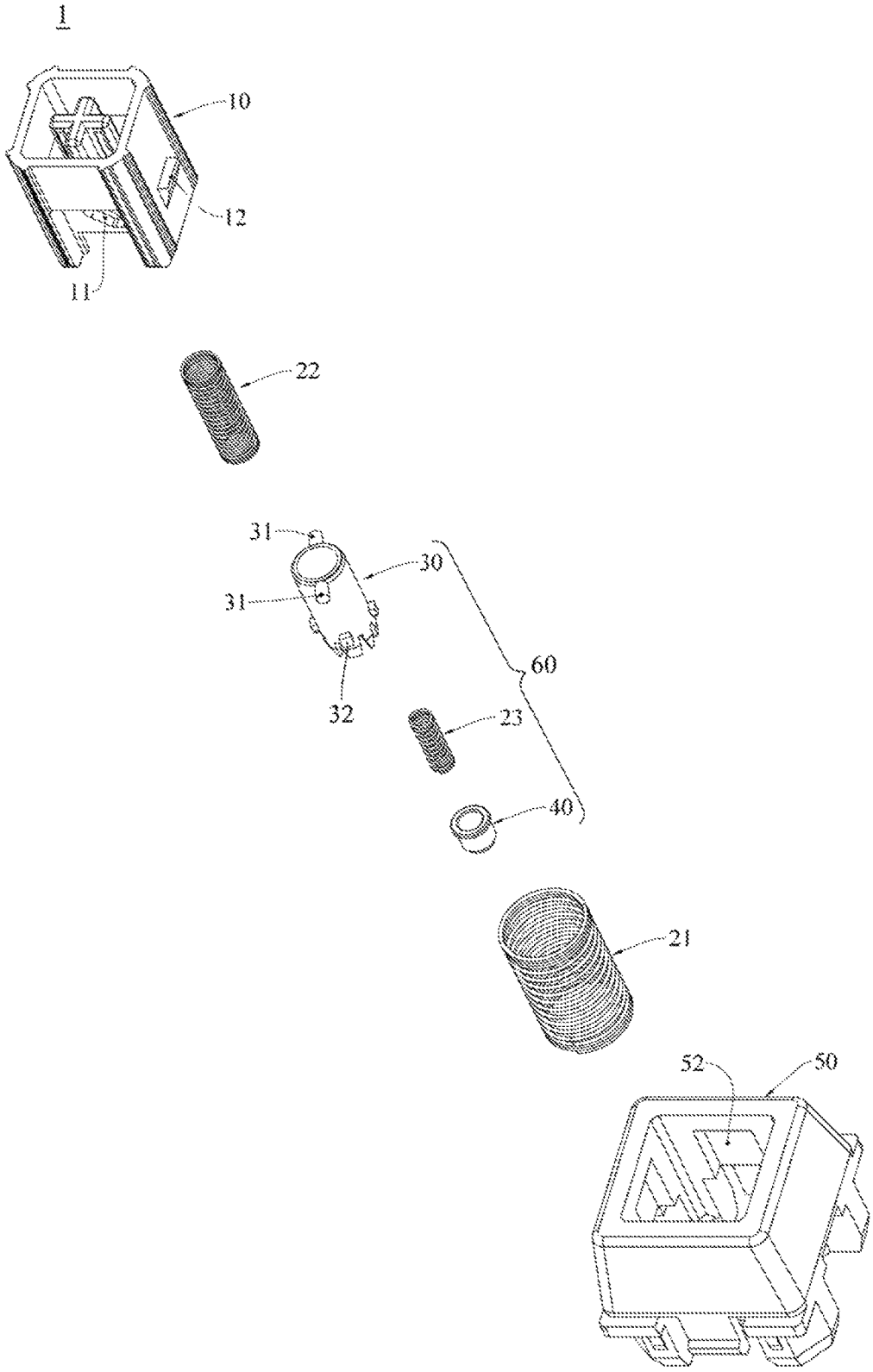
FIG. 1 is an exploded view of a keypad according to one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known main structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure. Furthermore, in order to simplify the drawings, some conventional structures and components are drawn in a simplified manner to keep the drawings clean.

Figure 2:
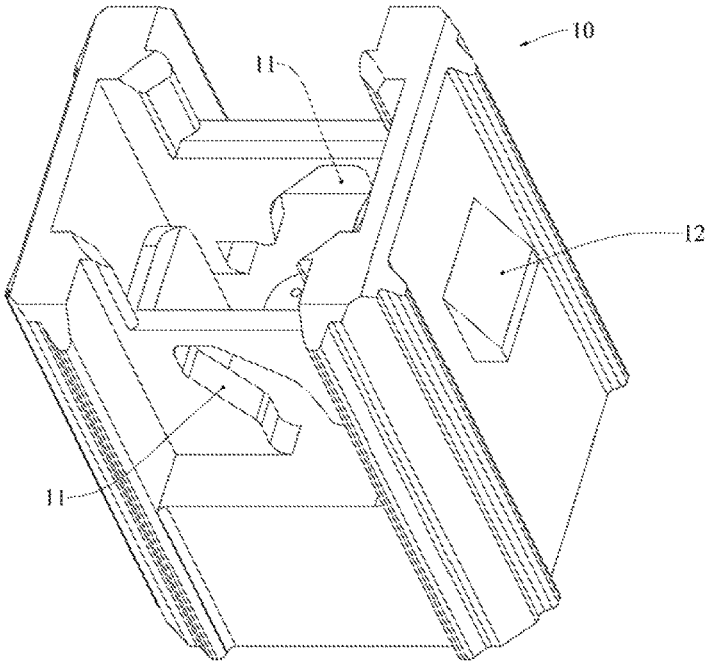
FIG. 2 is a perspective view of an actuator in FIG. 1.
Figure 3:
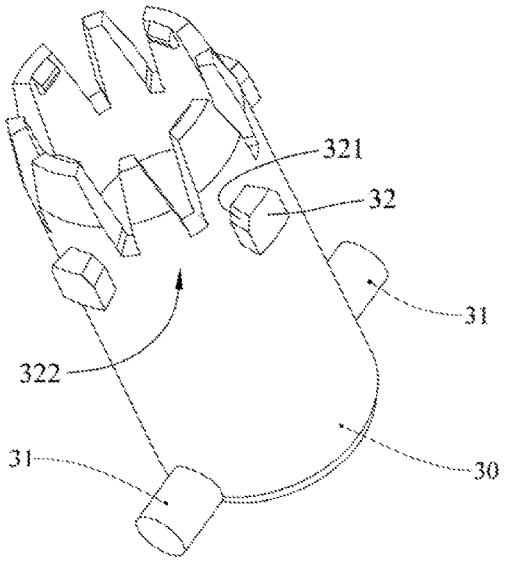
FIG. 3 is a perspective view of a pivotal plunger in FIG. 1.

Please refer to FIGS. 1-4. FIG. 1 is an exploded view of a keypad according to one embodiment of the disclosure, FIG. 2 is a perspective view of an actuator in FIG. 1, FIG.

Figure 4:
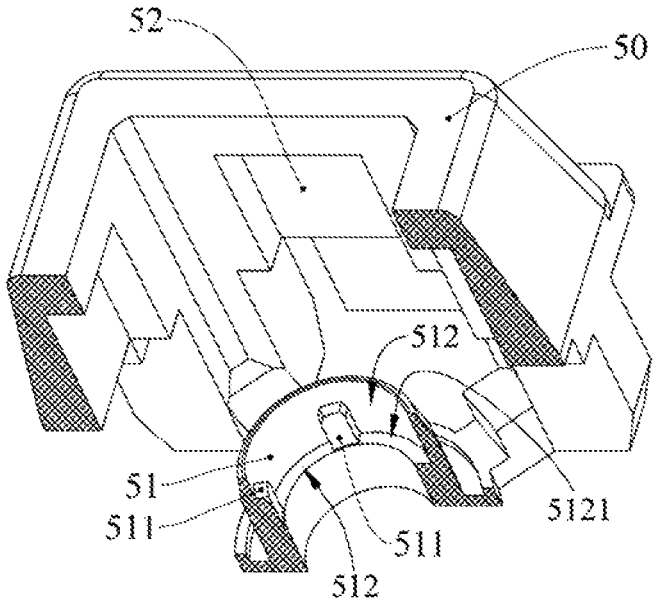
FIG. 4 is a cross-sectional view of a base in FIG. 1.

3 is a perspective view of a pivotal plunger in FIG. 1, and FIG. 4 is a cross-sectional view of a base in FIG. 1.

As shown in FIG. 1, this embodiment provides a keypad 1. The keypad 1 is suitable for incorporation in a membrane keyboard. In this embodiment, the keypad 1 includes a base 50, an actuator 10, a first elastic member 21, a pivotal mechanism 60 and a second elastic member 22.

Figure 6:
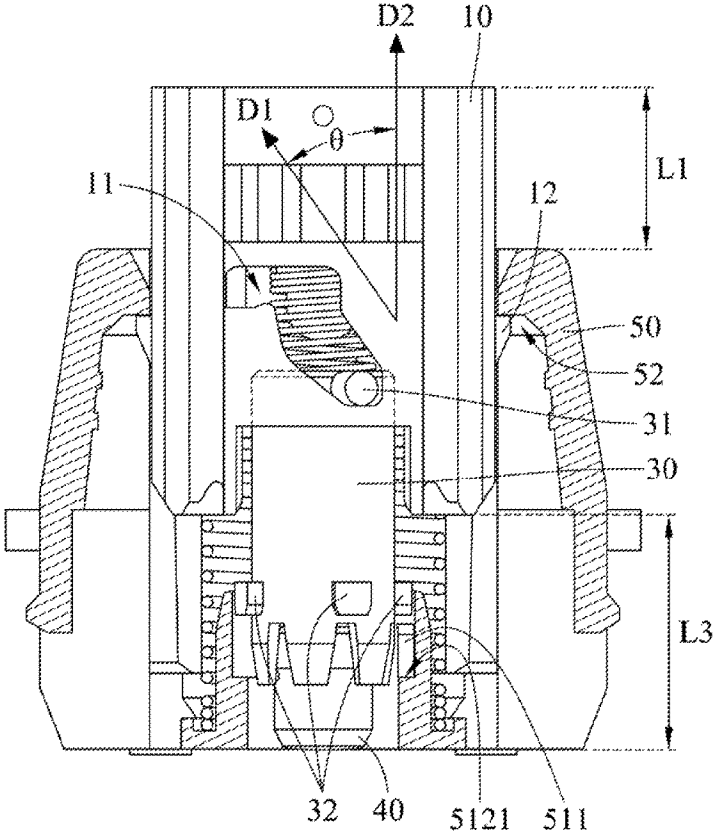
FIGS. 5-10 show the operation of the keypad in FIG. 1.
Figure 5:
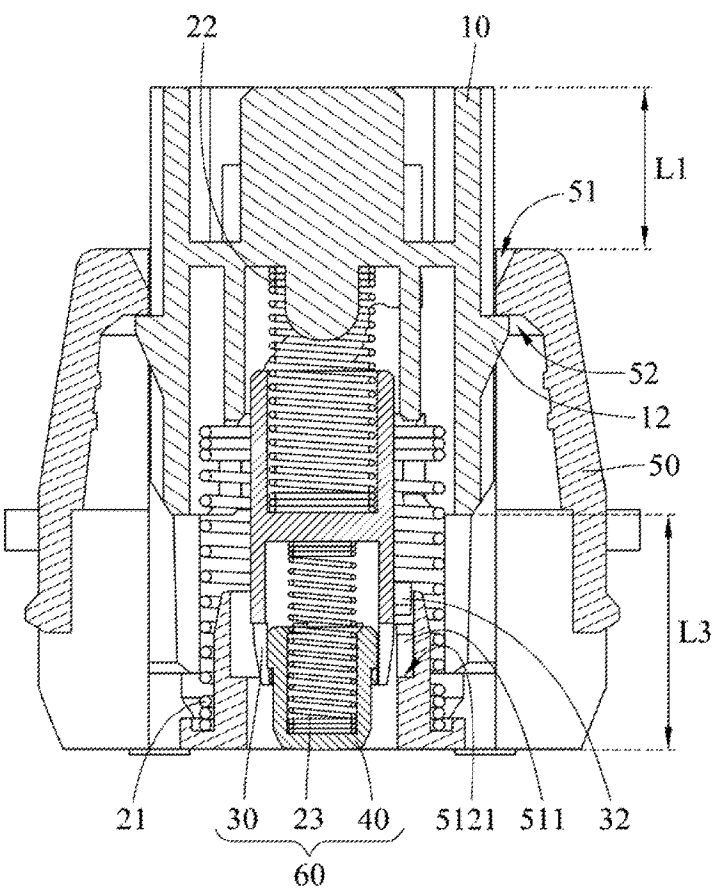
Figure 8:
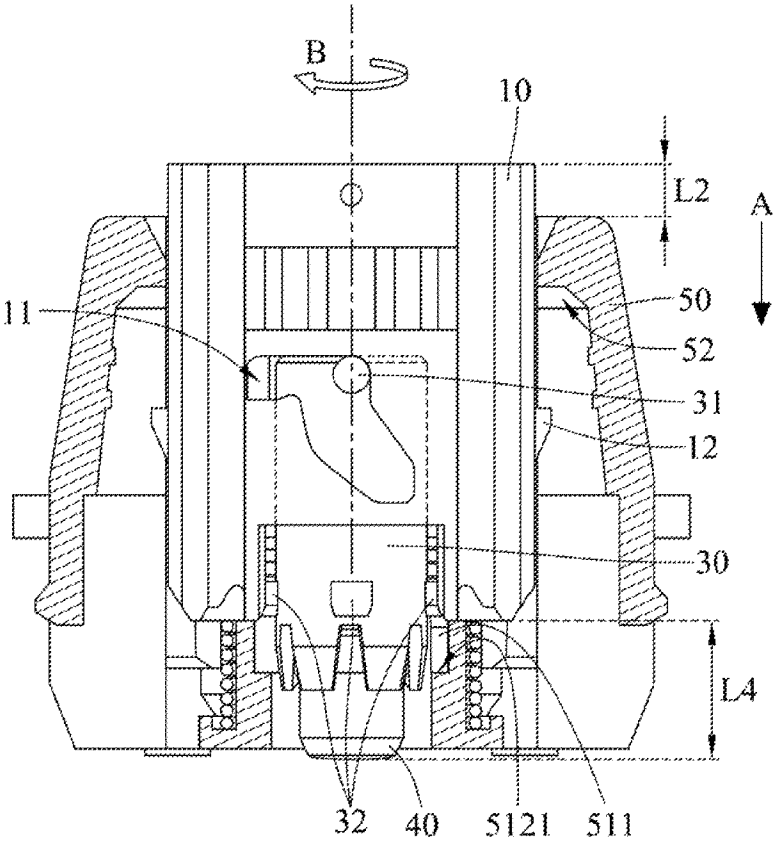
Figure 7:
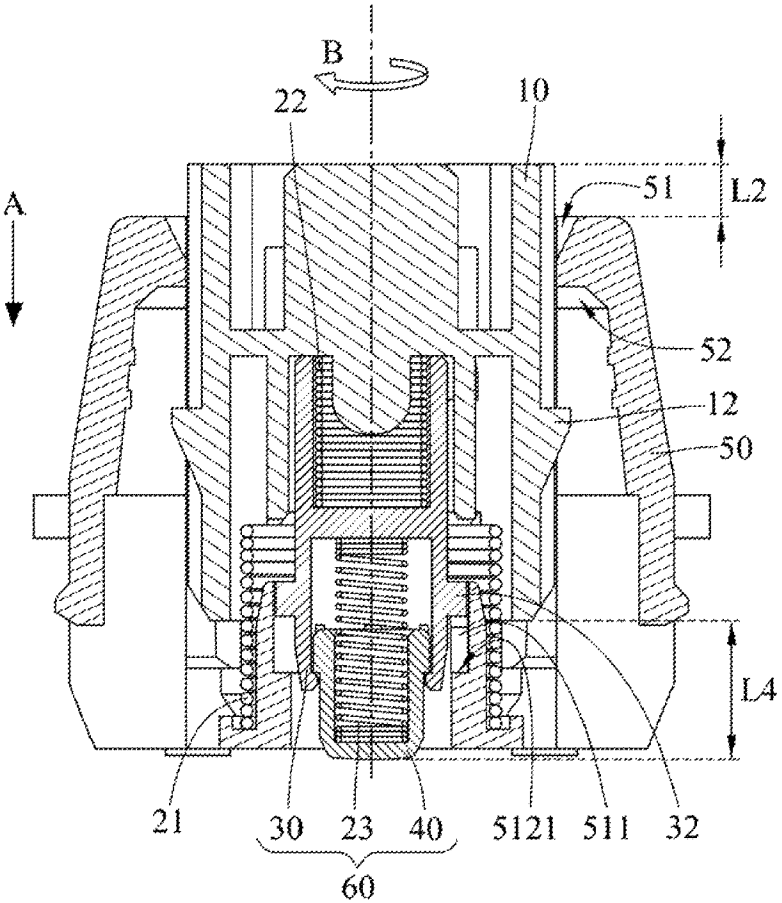

As shown in FIG. 4, the base 50 has a through hole 51, and the actuator 10 is movably located in the through hole 51 so as to be moved between an initial position (as shown in FIGS. 5-6) and a pressed position (as shown in FIGS. 7-8) with respect to the base 50. Specifically, the base 50 has a plurality of slide grooves 52 on its inner surface, and the actuator 10 has a plurality of slide blocks 12 thereon that respectively correspond to the slide grooves 52, such that the slide blocks 12 are respectively slidably disposed in the slide grooves 52. However, the quantities of the slide blocks 12 and the slide grooves 52 are not restricted; for example, in some other embodiments, the actuator may have only one slide block and the base may have only one slide groove.

In addition, two opposite ends of the first elastic member 21 respectively presses against the base 50 and the actuator 10 in order to provide force on the actuator 10 to move it towards the initial position. On the other hand, the actuator 10 is able to be pressed downward toward the pressed position. When the actuator 10 is in the initial position, a length L1 of the part of the actuator 10 sticking out the base 50 is greater than a length L2 of the part of the actuator 10 sticking out the base 50 when the actuator 10 is in the pressed position.

The pivotal mechanism 60 is pivotably and linearly movably disposed on the actuator 10 so as to be moved between a withdrawn position (as shown in FIG. 7) and a protruding position (as shown in FIG. 8) with respect to the actuator 10. In detail, the pivotal mechanism 60 includes a pivotal plunger 30, a touch pad 40 and a third elastic member 23. One end of the third elastic member 23 is connected to the pivotal plunger 30, and the touch pad 40 is disposed at the other end of the third elastic member 23, such that the third elastic member 23 is located between and connected to the pivotal plunger 30 and the touch pad 40. The touch pad 40 is able to be moved close to or away from the pivotal plunger 30, and the third elastic member 23 is able to force the touch pad 40 to move always from the pivotal plunger 30.

In addition, the actuator 10 has two guide grooves 11, and the pivotal plunger 30 has two protrusions 31 on its outer surface and extending along its radial direction. The protrusions 31 are respectively slidably located in the guide grooves 11, and an extension direction D1 of each guide groove 11 has an acute angle 9 with respect to a press direction D2 of the actuator 10 (as shown in FIG. 6), allowing the pivotal mechanism 60 to slide along and pivot about an axis of the actuator 10 and making the pivotal mechanism 60 to be moved to the withdrawn position (as shown in FIGS. 7-8) and the protruding position (as shown in FIGS. 5-6). Furthermore, the second elastic member 22 is located between and connected to the actuator 10 and the pivotal plunger 30 in order to provide force on the pivotal mechanism 60 to move it towards the protruding position. As shown in FIGS. 5-8, when the pivotal mechanism 60 is in the protruding position, a length L3 of the part of the pivotal mechanism 60 sticking out the actuator 10 is greater than a length L4 of the part of the pivotal mechanism 60 sticking out the actuator 10 when the pivotal mechanism 60 is in the withdrawn position.

In addition, the quantities of the guide grooves 11 and the protrusions 31 are not restricted. For example, in some other embodiments, the actuator may have only one guide groove, and the pivotal plunger may have only one protrusion.

Moreover, in this embodiment, the base 50 has a plurality of stop blocks 511 and a plurality of recesses 512 that are annularly formed on an inner surface forming the through hole 51. Each recess 512 has a bottom surface 5121. The pivotal plunger 30 has four teeth 32. The teeth 32 are annularly arranged on the outer surface of the pivotal plunger 30. The teeth 32 are spaced apart from each other, and the distance between the adjacent teeth 32 is larger than a width of the stop block 511, enabling the stop block 511 to pass through the area between the adjacent teeth 32.

Specifically, each of the two opposite sides of each tooth 32 has an inclined surface 321 for contacting the stop blocks 511 so as to guide the movement of the stop blocks 511, making the teeth 32 to move more smoothly.

It is noted that the quantities of the teeth 32 and the stop blocks 511 are not restricted and can be adjusted according to actual requirements.

Please further refer to FIGS. 5-10. FIGS. 5-10 show the operation of the keypad in FIG. 1.

Firstly, as shown in FIGS. 5-6, the keypad 1 is not pressed yet; that is, the actuator 10 is in the initial position, and the pivotal mechanism 60 is in the protruding position. At this moment, the actuator 10 relatively sticks out the top of the base 50, and the teeth 32 of the pivotal plunger 30 press against the stop blocks 511.

Then, as shown in FIGS. 7-10, the actuator 10 is pressed toward the pressed position along a direction A. While the actuator 10 is moving toward the pressed position, the actuator 10 forces the pivotal mechanism 60 to pivot and then move downward. In detail, the movement of the actuator 10 from the initial position to the pressed position can be divided into two phases. During the first phase, the actuator 10 is moving along the direction A; however, the movement of the actuator 10 along the direction A would force the teeth 32 to pivot along a direction B because the teeth 32 are stopped by the stop blocks 511 and the guide grooves 11 guide the protrusions 31 on the pivotal plunger 30 to move along the direction B.

Then, at the second phase, the teeth 32 moved along the direction B are not stopped by the stop blocks 511. At this moment, the actuator 10 is in the pressed position, and the pivotal mechanism 60 is in the withdrawn position.

Figure 10:
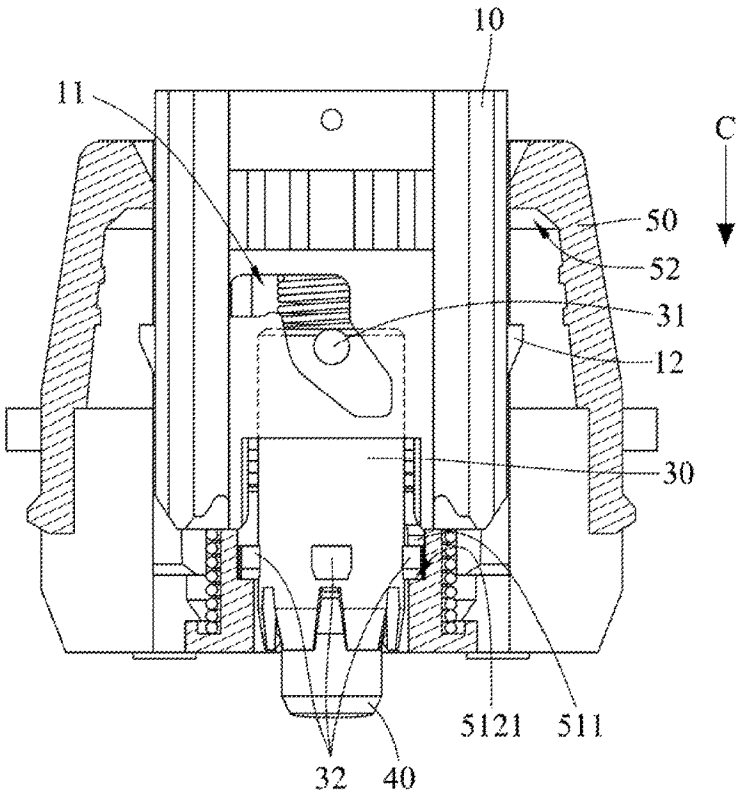
Figure 9:
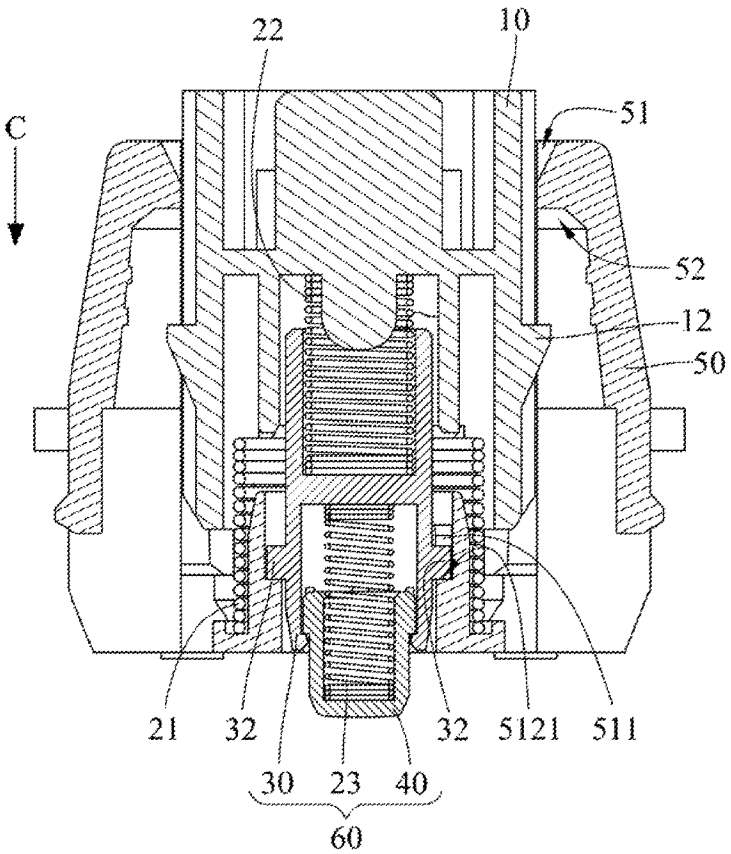

As shown in FIGS. 9-10, when the teeth 32 are not stopped by the stop blocks 511, the pivotal plunger 30 is moved downward along a direction C by being pushed by the second elastic member 22, such that the teeth 32 are also moved along the direction C to enter the recesses 512 and hit the bottom surfaces 5121, and the touch pad 40 touches a switch (not shown). At this moment, the actuator 10 is in the pressed position, and the pivotal mechanism 60 is in the protruding position. It is noted that, while the teeth 32 are entering the recesses 512, the stop blocks 511 seem moving toward the top end of the pivotal plunger 30.

As a result, a sound is produced when the teeth 32 hit the bottom surfaces 5121 of the recesses 512 at the moment that the touch pad 40 touches the switch. Therefore, the keypad 1 is able to provide a tactile feedback and a respective sound similar to that of a mechanical keypad in mechanical keyboard.

According to the keypad as discussed above, due to the cooperation of the protrusion and the slide groove, when the actuator is being pressed, the protrusion of the pivotal plunger is guided by the guide groove of the actuator and the second elastic member to make the teeth on the pivotal plunger to hit the bottom surface of the base so as to produce a sound. Therefore, in the case that the keypad of the present disclosure to be used in a membrane keyboard, it not only can provide dust-proof and moisture-proof effects but also can provide a tactile feedback and a respective sound similar to that of a mechanical keypad.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A keypad, comprising:

a base, having a through hole;

an actuator, movably located in through hole so as to be moved between an initial position and a pressed position with respect to the base;

a first elastic member, located between and connected to the base and the actuator in order to provide force on the actuator to move the actuator towards the initial position;

a pivotal mechanism, pivotably and linearly movably disposed on the actuator so as to be moved between a withdrawn position and a protruding position; and a second elastic member, located between and connected to the actuator and the pivotal mechanism in order to provide force on the pivotal mechanism to move the pivotal mechanism towards the protruding position;

wherein, the base has at least one stop block and at least one recess connected to each other on an inner surface forming the through hole, the pivotal mechanism has at least one tooth; when the actuator is in the initial position, the pivotal mechanism is in the protruding position; while the actuator is moved to the pressed position from the initial position, the at least one tooth of the pivotal mechanism is stopped by the at least one stop block so that the pivotal mechanism is pivoted and then linearly moved to the withdrawn position, and then the at least one tooth enters into the at least one recess, enabling the pivotal mechanism to the protruding position and press a switch; and wherein the pivotal mechanism comprises a pivotal plunger, a touch pad and a third elastic member, the pivotal plunger is pivotably and linearly movably disposed on the actuator, the touch pad is movably disposed on the pivotal plunger so as to be moved close to or away from the pivotal plunger, and the third elastic member is located between and connected to the pivotal plunger and the touch pad so as to force the pivotal plunger and the touch pad to be moved away from each other.

2. The keypad according to claim 1, wherein the pivotal plunger has at least one protrusion which is located on an outer surface thereof and extends along a radial direction thereof, the actuator has at least one guide groove, the at least one protrusion is slidably located in the at least one guide groove, and an extension direction of the at least one guide groove has an acute angle with respect to a press direction of the actuator.

3. The keypad according to claim 2, wherein the quantity of the at least one guide groove is two, and the two guide grooves are respectively disposed on two opposite sides of the actuator; the quantity of the at least one protrusion is two, and the two protrusions are respectively disposed on two opposite sides of the pivotal plunger, and the two protrusions are respectively slidably located in the two guide grooves.

4. The keypad according to claim 1, wherein the quantity of the tooth is plural, the teeth are spaced apart from each other, and a distance between the teeth adjacent to each other is larger than a width of the at least one stop block.

5. The keypad according to claim 4, wherein the quantity of the teeth is four, and the teeth are annularly arranged on an outer surface of the pivotal plunger.

6. The keypad according to claim 1, wherein each of two opposite sides of each of the at least one tooth has an inclined surface for contacting the at least one stop block.

7. The keypad according to claim 1, wherein the quantity of the at least one stop block is four, and the stop blocks are annularly formed on the inner surface of the through hole.

8. The keypad according to claim 1, wherein the actuator has at least one slide block thereon, the base has at least one slide groove on an inner surface thereof and corresponding to the at least one slide block, and the at least one slide block is slidably disposed in the at least one slide groove so as to guide the actuator.

9. A keypad, comprising:

a base, a actuator, a pivotal mechanism, a first elastic member disposed between the base and actuator for recovering the actuator, a second elastic member disposed between the pivotal mechanism and the actuator for recovering the pivotal mechanism, a top side of the pivotal mechanism is inserted into the actuator, the base has a through hole and at least one stop block which is on an inner surface forming the through hole, the actuator is movably located in the through hole, and a bottom side of the pivotal mechanism has at least one tooth;

wherein the pivotal mechanism comprises a pivotal plunger, a touch pad and a third elastic member, the pivotal plunger is pivotably and linearly movably disposed on the actuator, the touch pad is movably disposed on the pivotal plunger so as to be moved close to or away from the pivotal plunger, and the third elastic member is located between and connected to the pivotal plunger and the touch pad so as to force the pivotal plunger and the touch pad to be moved away from each other, and wherein, when the actuator is pressed, the actuator forces the pivotal mechanism to pivot about a press direction of the actuator, such that the at least one stop block is moved away from the at least one tooth and moved toward the top side of the pivotal mechanism.

* * * * *